US008457521B2

(12) United States Patent
Pitas et al.

(10) Patent No.: US 8,457,521 B2
(45) **Date of Patent: *Jun. 4, 2013**

(54) METHOD FOR PREVENTING DAMAGE TO A PHOTOCONDUCTOR

(75) Inventors: Jeffrey A. Pitas, Macedon, NY (US); Matthias H. Regelsberger, Rochester, NY (US); Richard G. Luther, Hamlin, NY (US)

(73) Assignee: Eastman Kodak Company, Rochester, NY (US)

( * ) Notice: Subject to any disclaimer, the term of this patent is extended or adjusted under 35 U.S.C. 154(b) by 262 days.

This patent is subject to a terminal disclaimer.

(21) Appl. No.: 12/849,044

(22) Filed: Aug. 3, 2010

(65) Prior Publication Data

US 2012/0033992 A1 Feb. 9, 2012

(51) Int. Cl.
*G03G 15/00* (2006.01)

(52) U.S. Cl.
USPC ..... 399/111

(58) Field of Classification Search
USPC ..... 399/8, 111, 114, 116
See application file for complete search history.

(56) References Cited

U.S. PATENT DOCUMENTS

| | | | | |
|---|---|---|---|---|
| 4,766,455 | A * | 8/1988 | Carter | 399/116 |
| 5,918,091 | A * | 6/1999 | Saeki | 399/162 |
| 5,943,527 | A * | 8/1999 | Kashiwagi et al. | 399/90 |
| 6,018,637 | A | 1/2000 | Huss et al. | |
| 6,175,704 | B1 * | 1/2001 | Yamamoto | 399/116 |
| 6,882,821 | B2 | 4/2005 | Jeong et al. | |
| 6,937,838 | B2 | 8/2005 | Ishii et al. | |
| 7,330,678 | B2 | 2/2008 | Kadowaki et al. | |
| 7,373,092 | B2 | 5/2008 | Tawada | |
| 7,383,000 | B2 | 6/2008 | Koumoto et al. | |
| 7,471,916 | B2 | 12/2008 | Sanada et al. | |
| 7,505,711 | B2 | 3/2009 | Yoshimoto et al. | |
| 7,515,838 | B2 | 4/2009 | Kadowaki et al. | |
| 7,620,358 | B2 | 11/2009 | Kadowaki et al. | |
| 7,650,086 | B2 | 1/2010 | Takahashi et al. | |
| 7,672,627 | B2 | 3/2010 | Suzuki et al. | |
| 8,055,154 | B2 * | 11/2011 | Iikura et al. | 399/111 |
| 2007/0206972 | A1 * | 9/2007 | Tanaka | 399/114 |
| 2010/0061762 | A1 * | 3/2010 | Stuckey et al. | 399/116 |
| 2010/0142992 | A1 * | 6/2010 | Hayashi | 399/111 |

* cited by examiner

*Primary Examiner* — Quana M Grainger
(74) *Attorney, Agent, or Firm* — Nelson Adrian Blish

(57) ABSTRACT

An in situ replacement of a cartridge (200) for an electrophotographic printer includes providing a rigid, cylindrical photoreceptive member (206) enclosed in a housing (233), wherein the housing comprises a removable shield (231*a*, 231*b*); inserting the housing and photo receptive member into the printer; and removing the shield.

8 Claims, 3 Drawing Sheets

METHOD FOR PREVENTING DAMAGE TO A PHOTOCONDUCTOR

CROSS REFERENCE TO RELATED APPLICATIONS

Reference is made to commonly-assigned U.S. patent application Ser. No. 12/849,041 (now U.S. Publication No. 2012/0033991), filed Aug. 3, 2010, entitled PREVENTING DAMAGE TO A PHOTOCONDUCTOR, by Pitas et al.; the disclosure of which is incorporated herein.

FIELD OF THE INVENTION

The present invention relates to electrophotography in general, and in particular to a replacement cartridge for an electrophotographic printer.

BACKGROUND OF THE INVENTION

Electrophotographic equipment utilizes sensitive components that must be routinely serviced by either dedicated service personnel or by the end user. Many of these components are easily damaged unless care is exercised during replacement. In some instances, it is considered imprudent to depend upon an individual exercising care as a step in carrying out critical operation. This is especially important when the risk of error is high, and the cost and machine down-time associated with error is great.

A primary component requiring frequent replacement within an electrophotographic print engine is the photoreceptive member. The function of the photoconductor is to provide a means of developing an image and transferring that image to paper. The photoreceptive member is coated with photosensitive material which is essential to operation of electrographic printers. The photosensitive material is easily scratched and can be damaged by exposure to ambient light if handled imprudently. This type of damage creates unacceptable image quality defects in the transferred image.

In close proximity to the receptive member are many components that support the imaging of the photoconductor. These components can scratch or abrade the photoreceptive member during replacement. There is a need to eliminate the potential for damage to the photoreceptive member.

SUMMARY OF THE INVENTION

Briefly, according to one aspect of the present invention an in situ replacement of a cartridge for an electrophotographic printer includes providing a rigid, cylindrical photoreceptive member enclosed in a housing, wherein the housing comprises a removable shield; inserting the housing and photo receptive member into the printer; and removing the shield.

The invention and its objects and advantages will become more apparent in the detailed description of the preferred embodiment presented below.

DETAILED DESCRIPTION OF THE INVENTION

An electrophotographic printer includes all components necessary to accomplish the task of printing an image on paper. A printer is comprised of various subassemblies which perform specific functions.

Figure 1:
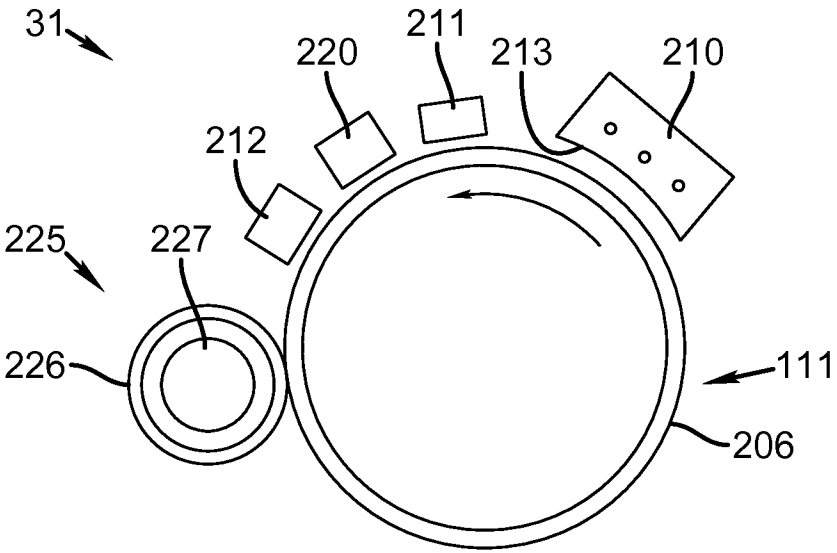
FIG. 1 is an cross-section of a replacement cartridge according to the present invention.

An imaging module in the printer consists of components to enable printing of a single color image. Multiple modules may be assembled to enable the printing of multiple color images. FIG. 1 shows details of a typical printing module 31, which may be assembled with other imaging modules to enable printing multiple colors.

Primary charging subsystem 210 uniformly electrostatically charges photoreceptor 206 of photoreceptive member 111, shown in the form of an imaging cylinder. Charging subsystem 210 may include a grid 213 having a selected voltage, or may be in the form of a roller with conductive properties.

Additional necessary components provided for control may be assembled around the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptive member 206.

Image writer 220 is used to expose photoreceptive member 206 and may be a light emitting diode (LED) array or other similar mechanisms or laser. Toning unit 225, comprising elements 226 and 227 is used to develop the latent image created by image writer 220 on photoreceptive member 206. Cleaning unit 230 removes residual toner from photoreceptive member 206 after transfer of the image to secondary receiver (not shown). Other meters and components may be included.

Within the imaging module 31, periodic replacement of critical components is necessary to ensure proper function. It may be desired to cluster multiple components to enable simultaneous replacement.

Figure 2:
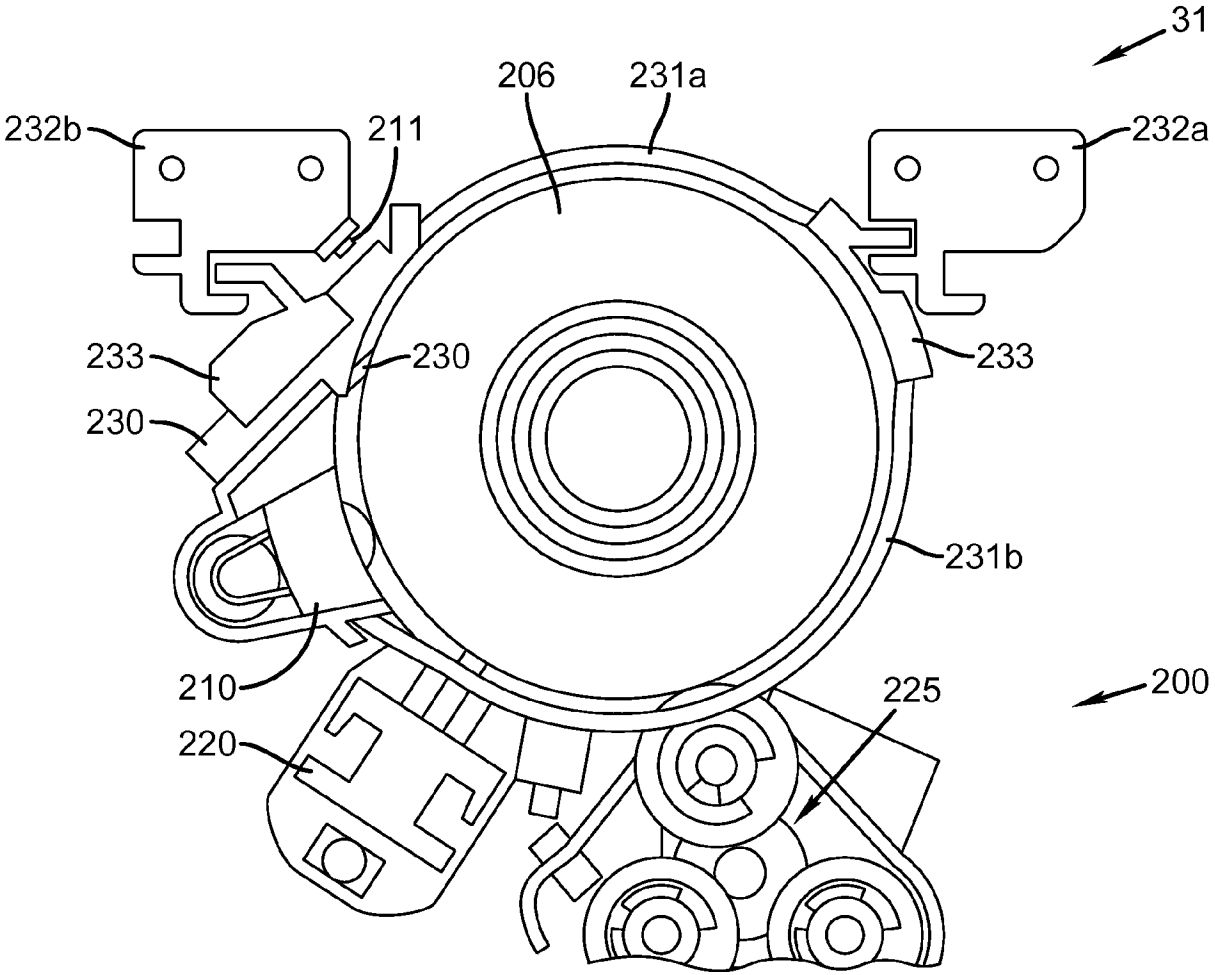
FIG. 2 is a cross-section of a replacement cartridge in an electrophotographic printer.
Figure 3:
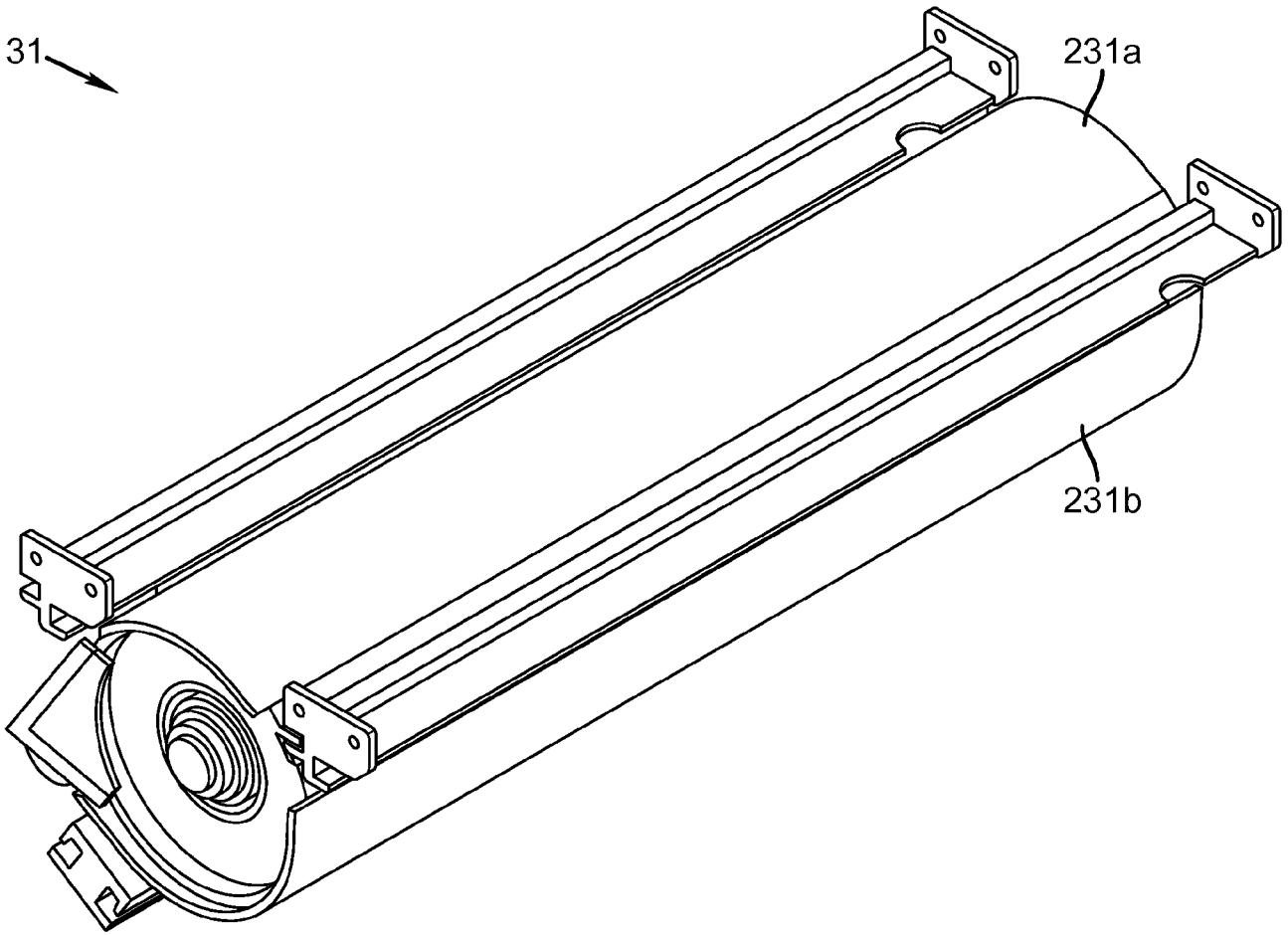
FIG. 3 is a perspective view of the replacement cartridge shown in FIG. 2

Referring to FIG. 2, shown here with a change in form, for the present invention a replacement cartridge 200 within imaging module 31 is created consisting of a photoreceptive member 206, cleaning unit 230, and charger 210. These components are assembled into a cartridge and held in place with a plastic housing 233. Further, protective guards 231*a* and 231*b* are applied to the module, which serve to prevent damage to the photoreceptive member 206. The replacement cartridge slides into the electrophotographic printer with guides 232*a* and 232*b*. Guides 232*a* and 232*b* are attached to the printer and help mount and align the replacement cartridge in the proper position.

Because of the proximity of subsystems that interface with module 31 and with replacement cartridge 200, it is necessary to have large areas of the photoreceptive member open during use. During insertion into the print engine, these open, unprotected areas could be damaged either mechanically or by light exposure. Therefore it is necessary to protect the photoreceptive member 206 from damage, either from extraneous light, fingerprints, or mechanical scrapes. The protective guards 231*a* and 231*b*, also referred to as a removable shield, slide in place in grooves within the replacement cartridge housing. These removable shields 231*a* and 231*b* stay in place when the cartridge is installed in the printer, and are removed by sliding out of the housing to the front of the equipment after the replacement cartridge 200 is in place in the printer.

The invention has been described in detail with particular reference to certain preferred embodiments thereof, but it will be understood that variations and modifications can be effected within the scope of the invention.

PARTS LIST

31 module
111 photoreceptive member
200 replacement cartridge
206 photoreceptive member
210 subsystem
211 meter
212 meter
213 grid
220 image writer
225 toning unit
226 element
227 element
230 cleaning unit
231*a* protective guards (removable shield)
231*b* protective guards (removable shield)
232*a* guide
232*b* guide
233 plastic housing

The invention claimed is:

1. A method for in situ replacement of a cartridge for an electrophotographic printer comprising:

providing a rigid, cylindrical photoreceptive member enclosed in a housing, wherein the housing comprises a removable shield;

inserting the housing and photo receptive member into the printer;

removing the shield;

wherein the removable shield stays in place when the cartridge is installed in the printer and is removed by sliding the shield out of the housing toward the front of the printer after the replacement cartridge is in place in the printer; and wherein said removable shield is comprised of at least two parts and each part covers a portion of the photoconductor.

2. The replacement cartridge as in claim 1 further comprising:

a guide for maintaining a separation between the photoreceptive member and the removable shield.

3. The method as in claim 1 wherein the removable shield rests on a surface of the photoreceptive member.

4. The method as in claim 1 wherein the removable shield is opaque.

5. The method as in claim 1 wherein the housing comprises a component selected from a group consisting of a charging element, cleaning mechanism, writing mechanism, or toning mechanism.

6. The method as in claim 5 wherein the writing mechanism is an light emitting diode (LED) array.

7. The method as in claim 1 wherein the photoreceptive member is an organic photoreceptive member.

8. The method as in claim 7 wherein the photoreceptive member comprises a rigid cylindrical support.

* * * * *